US005201629A

United States Patent [19]

Simpson et al.

[11] Patent Number: 5,201,629

[45] Date of Patent: Apr. 13, 1993

[54] CONTAINER TRANSPORTER

[75] Inventors: Clark Simpson, Nicholasville; John Hodgman, Lexington, both of Ky.

[73] Assignee: Clark Material Handling Company, Lexington, Ky.

[21] Appl. No.: 682,758

[22] Filed: Apr. 9, 1991

[51] Int. Cl.[5] ..... B66F 9/22

[52] U.S. Cl. ..... 414/632; 187/9 E; 414/608; 414/635; 414/626; 180/306

[58] Field of Search ..... 414/608, 630, 631, 632, 414/634, 635, 636, 637, 638, 619, 626, 914; 301/124 R, 124 H, 125; 296/84.1, 190; 180/89.2, 296, 306, 905; 187/9 R, 9 E, 17

[56] References Cited

U.S. PATENT DOCUMENTS

| | | | |
|---|---|---|---|
| Re. 27,905 | 1/1974 | Whiteman | 414/608 X |
| 1,867,802 | 7/1932 | Bogert | 180/296 X |
| 2,503,181 | 4/1950 | Wagner | 414/914 X |
| 2,661,958 | 12/1953 | Stokes | 301/125 |
| 2,936,044 | 5/1960 | Vossenberg | 187/9 R |
| 3,135,347 | 6/1964 | Vranyosovics | 180/296 |
| 3,568,868 | 3/1971 | Chichester | 414/636 X |
| 3,595,343 | 7/1971 | Williamson | 187/9 R |
| 3,688,933 | 9/1972 | Rumell | 414/608 |
| 3,764,032 | 10/1973 | Ward | 414/608 |
| 3,802,530 | 4/1974 | Purcell et al. | 296/190 X |
| 3,866,969 | 2/1975 | Sandrock et al. | 296/190 |
| 3,918,546 | 11/1975 | Chichester et al. | 187/9 R X |
| 4,023,650 | 5/1977 | Pleier | 187/9 R |
| 4,147,034 | 4/1979 | Johnson | 180/306 X |
| 4,382,485 | 5/1983 | Kirkham | 180/306 |
| 4,449,882 | 5/1984 | Perrott | 414/608 X |
| 4,506,747 | 3/1985 | Wykhuis | 180/905 X |
| 4,552,250 | 11/1985 | Luebrecht | 187/9 E |
| 4,995,469 | 2/1991 | Mikkelsen et al. | 296/190 X |

OTHER PUBLICATIONS

Clark C500Y800D Brochure, 1978 (16 pages) supplied by applicant as prior art.

Clark C500Y800D Specification Sheet, 1978 (2 pages) supplied by applicant as prior art.

*Primary Examiner*—Michael S. Huppert
*Assistant Examiner*—James Keenan
*Attorney, Agent, or Firm*—Jack E. Toliver

[57] ABSTRACT

A self-propelled, counterbalanced, container transporter vehicle having a frame, a counterweight supported at the rear, an elevating upright, carriage pick-up and lift frame assembly for lifting, transporting and stacking containers in which a tower structure supports a cab providing an operator's station with controls for hydraulically raising and lowering the upright, the cab has a wide angle front window area that partially wraps around the operator's station to permit a horizontal line of sight to the maximum extension of the lift frame and is sloped back to afford high angle vision to the maximum vertical extension of the upright for high stacking containers. In addition, the tower structure is positioned rearwardly of the center, and projects upwardly to a height that provides an elevated line of sight from the cab through the upright, the inner rail section of which is shorter than the outer rails to allow a better view through the upright and beneath a container in the transport, partially elevated position and the outer rails being mounted on the frame closer together to narrow the track width of the vehicle for better spotting containers on the tarmac.

10 Claims, 8 Drawing Sheets

CONTAINER TRANSPORTER

THE FIELD OF ART

The field of art to which the invention pertains relates to large, self-propelled, load handling vehicles primarily used for picking up, transporting and stacking ISO shipping containers stored at wharfs, container yards or transport terminals.

BACKGROUND OF THE INVENTION

Various transport machines exist in the prior art for lifting, loading and stacking containers ranging from cranes and derricks to forms of straddle lift van carriers and lift trucks equipped with special gooseneck and lift frame attachment.

The containers themselves come in twenty or forty foot lengths and are standardized, in dimension for volumetric uniformity, as set forth in the American National Standards Institute (ANSI), 1430 Broadway Street, New York standards entitled "Specifications for Cargo Containers" (publication number MH5.1-1965).

It is common practice around docks, wharfs or transport terminals to use large lift trucks as container handlers by outfitting them with a gooseneck from which is suspended a lift frame, a rectangular structure having hydraulically extendable ends to accommodate either the twenty or forty foot container. At the corners of the lift frame are twist locks which engage standardized receptacles in upper corners of the container when the lift frame is lowered onto the container.

Such a lift frame is described in U.S. Pat. No. 3,764,032 issued Oct. 9, 1973 and titled "Container Handling Device" assigned to the assignee of the present invention.

The twist locks are constructed according to International Standards Organization requirements and are located at each corner of the frame. They are actuated from the operator's cab where green and red lights on the control console indicate the status of lock engagement with the container.

The lift frame is also capable of being hydraulically side shifted and turned or slewed relative to the lift truck by means of hydraulic cylinders actuated by the hydraulic circuit of the lift truck, however, in order to achieve the productivity gains sought that the maneuvering of the lift frame will allow, it is necessary for the operator to have adequate visibility of the twist locks and without also moving the lift truck, for rapid engagement with the corner fittings of the container in securing it to the lift frame.

The lift truck will have a hydraulically elevatable mast or upright often used with other attachments, such as forks, and for such purpose it is necessary to locate the operator's cab forward, close to the upright, for adequate visibility of the forktips in picking up loose loads or pallets. The optimum cab position for fork visibility is not the same as for maneuvering the lift frame when handling containers.

The lift truck will also have a structure, integral with the frame, overhanging the cab to protect the operator from falling loads, an overhead guard, the structural strength of which will meet or exceed the safety requirements of ANSI B56.1 and the Occupational Safety and Health Act, Subpart N Section 1910.178 for Powered Industrial Trucks. The overhanging portion will usually be a grill of ribs leaving openings for visibility at lift heights necessary for stacking shipping containers, nevertheless it has a tendency to reduce visibility from within the cab which has a window in the roof directly above the operator's station for the purpose of being able to see at such heights. The visibility is further restricted by the fact that the window is hard to keep clean beneath the overhead guard.

The lift truck frame will have massive side rails supporting a counterweight and steer axle at the rear, an engine, a drive axle housing at the front bolted to the frame having tandem gear reduction hubs, differential gearing and other drive line components placed within the housing and the upright or mast of the fork lift truck mounted on trunions at either end of the housing. Hydraulic cylinders are actuated from controls in the cab to back or forward tilt the upright on its trunion mountings to the axle housing.

It is also common for the upright of a heavy forklift truck, such as required for lifting containers having capacities which range up to eighty or even a hundred thousand pounds, to have a relatively massive upright structure. The upright will have parallel outer rails secured on trunions to the axle and a moveable inner rail section that telescopes within the outer rails when raised and lowered on rollers by a hydraulic cylinder. Chains anchored to a cross-member between the outer rails travel over sheaves at the top of the inner rail section and extend down the other side fastening on to a carriage which travels on rollers mounted on the inner rail section. The forks or other attachment are mounted on the carriage. When the truck is used for lifting containers, the forks are taken off and a gooseneck is attached to the carriage from which the lift frame is suspended on chains for converting the lift truck into a container handler.

The upright inner rail section is typically the same length as the outer rails to achieve maximum overlap of the roller sets in lifting the heavy loads. This creates a thicker rail cross-section when the upright is collapsed around which the operator must see in spotting containers on the tarmac.

It is common to exhaust the engine through a stack pipe directly behind the operator's cab which has a tendency to allow exhaust gases to be ejected over the top of the cab and to the rear which not only raises emission levels in the cab area, but also is a source of noise in the cab.

The hydraulic system of the lift truck will ordinarily have a pump for the upright lift and tilt cylinders driven off a torque converter from the engine, however lifting speeds adequate for heights usually found suitable for lift truck loads do not achieve the speeds desirable in container handling applications where thirty and forty-foot lifts are common.

SUMMARY OF THE INVENTION

The present invention provides a self-propelled, counterbalanced, load handling vehicle especially a container transport, which has several unique advantages over the type of container handler described above in the background of the invention. The container transporter of the invention has a frame comprised of parallel side rail members having a counterweight frame portion at the rear and an integral fabricated axle housing at the front, the ends of which are fabricated with bracket arms for supporting the upright. A tower structure supports a cab establishing an operator's position elevated relative to the ground so that the operator has visibility in the transport position beneath the standard shipping container, or when elevated on the upright to a height in readiness for stacking, or setting on the ground such that the operator's line of sight is unobstructed and optimized for container handling.

The invention is capable of a number of different embodiments, but in essence is a self-propelled container transporter specifically designed for container transporting, stacking and spotting, a reference to setting containers down on precise lines on the tarmac of a container yard or transport terminal.

The operator's position is preferably behind the center of the frame which removes him from the vicinity of the upright and avoids having to provide an overhead guard for protection against falling objects.

More particularly, the operator's vision from the cab is unobstructed by any overhead guard and by that fact alone has improved visibility when stacking containers above eye level.

In addition, in accordance with the invention, the front cab window wraps around the operator's station and slopes to the rear, extending from above to below the operator's line of sight for wide angle horizontal and vertical visibility.

The advantages of the wide angle window further being in that the window is composed of polyhedron panels sealed with narrow seams presenting a substantially continuous window area uninterrupted by vertical ribs or window frames.

Coupled with this advantage is the fact that a roof window in the cab is not required, such as in the prior art lift truck cab, which is difficult to keep clean, since the inclined surfaces of the invention are easily cleaned by wipers due to the inclination of the surface which does not hold dirt and grime to the same extent as the horizontal cab windows in the roof.

The invention lies not just in the cab but in the total arrangement of the vehicle including the frame, the structure of which permits visibility from the operator's station out through the rear window of the cab and over the back of the counterweight to a position on the ground much closer to the rear of the transporter than would otherwise be the case if the cab were at a more forwardly location.

The frame also has as one of its unique advantages, in terms of a container transporter, that the upright is pivoted to bracket arms fabricated at the ends of the side rail members of the frame which allows for reducing the track width of the drive axle facilitating better positioning of a container between positioning marks on the tarmac.

In addition the frame is provided with a cross-member fabrication between the side rail members providing a housing for the drive axle components, hence avoiding the cost and additional weight of a separate drive axle housing.

The arrangement of the frame fabrications allow the body panel at the forward end to be recessed for better visibility from the operator's station over the drive axle housing.

In addition the inner rail of the upright terminates above the lower end of the outer rail enhancing visibility between the upright when traveling empty or spotting containers on the tarmac, and the outer rails are extended by an equal amount to permit sufficient overlap when the inner rail section is elevated to maximum height to provide sufficient roller bearing contact and minimize deflection while improving visibility through the upright in the raised transport position.

A further advantage of the invention is that the hydraulic circuit for raising and lowering the upright includes interdependent auxiliary circuits which automatically sense the engine speed and lift circuit pressure to match the engine torque with the load and achieve optimum lift speed.

It is also a feature of the invention that the exhaust gases from the engine are not diverted through a stack behind the operator's compartment, but rather are carried forwardly from the exhaust manifold through piping to an opening in the outer rail of the upright which has been formed partly as an elongated tube allowing the exhaust gases to vent through the top of the outer rail reducing exhaust gases in the vicinity of the cab and at the same time the engine noise level reaching the operator's ear.

Accordingly, it is a chief object of the invention to provide a highly maneuverable, self-propelled, rear steered, counterbalanced vehicle for stacking, spotting or transporting shipping containers in a more efficient and productive manner achieved primarily through improving the visibility from the operator's station through and around the upright or mast of the vehicle permitting the operator to observe the edges and corners of the container and lift frame thereby reducing side shifting or slewing of the lift frame to more accurately and rapidly position the twist locks in the container receptacles.

It is a further object of the invention to provide a container transporter having improved visibility through the upright and also to the rear for avoiding hazards or collision with objects in the path of the transporter when moving without a container and with the lift frame and upright fully lowered;

Another object of the invention is to provide a container handler vehicle having a frame fabricated with an integral drive axle housing and upright bracket, permitting an arrangement to not only improve visibility but reduce the cost and weight;

A still further object of the present invention is to provide a container handler frame, having parallel side members structurally tied together at the front by a cross-member serving the dual purpose of housing the drive axle for the vehicle as well as mounting the upright in a pivotal fashion inside the track of the drive hubs sufficiently to narrow the track width of the vehicle and increase of visibility for positioning containers;

It is still another object of the invention to provide a frame having a tower structure for supporting a cab behind the frame center position from which position the angle of site from the operator's station in the cab ranges from a standard ISO four high shipping container stack to ground level through the front windows of the cab which can be easily wiped clean for continuous clear visibility;

It is another object of the invention to provide an upright or mast the inner rail section of which is shorter than the outer rails to improve the visibility through the upright, especially in the fully lowered position;

A further object of the present invention is to provide that the front end of the vehicle body is recesses behind the drive axle housing to improve the line of sight from the operator's station over the axle housing to aid in spotting containers or in avoiding objects in its path;

A further object of the invention is to provide a body structure providing ease of access to the cab by means of stairways constructed on opposite sides of the transporter leading to a deck surrounding the cab providing entry to the cab from either side of the machine assisted by hand rails for reaching or alighting from the deck area;

A still further object of the invention is to provide that the cab structure can pivot out of the way for access to the engine compartment;

Another object of the present invention is to provide that the engine exhaust gases are piped forwardly to an outer rail of the upright which is closed throughout its length permitting the exhaust gases to vent through the top of the outer rail of the upright and reduce noise and pollution in the cab area;

Still another object of the invention is to provide a hydraulic lift circuit that matches engine speed and torque to the load to optimize the productivity by increasing the lift speed at light or empty container conditions; and Still other objects of the present invention will become more apparent to those skilled in the art from the following description wherein there is shown and described a preferred embodiment of the invention by way of illustration of one of the modes best suited for carrying out the invention, however it can be appreciated that the invention is capable of other forms or modifications without materially departing from the scope thereof and it is understood that the following drawings and descriptions are to be regarded as illustrative and not restrictive in any manner of the scope of the invention.

DETAILED DESCRIPTION OF THE INVENTION

Figures 1, 2:
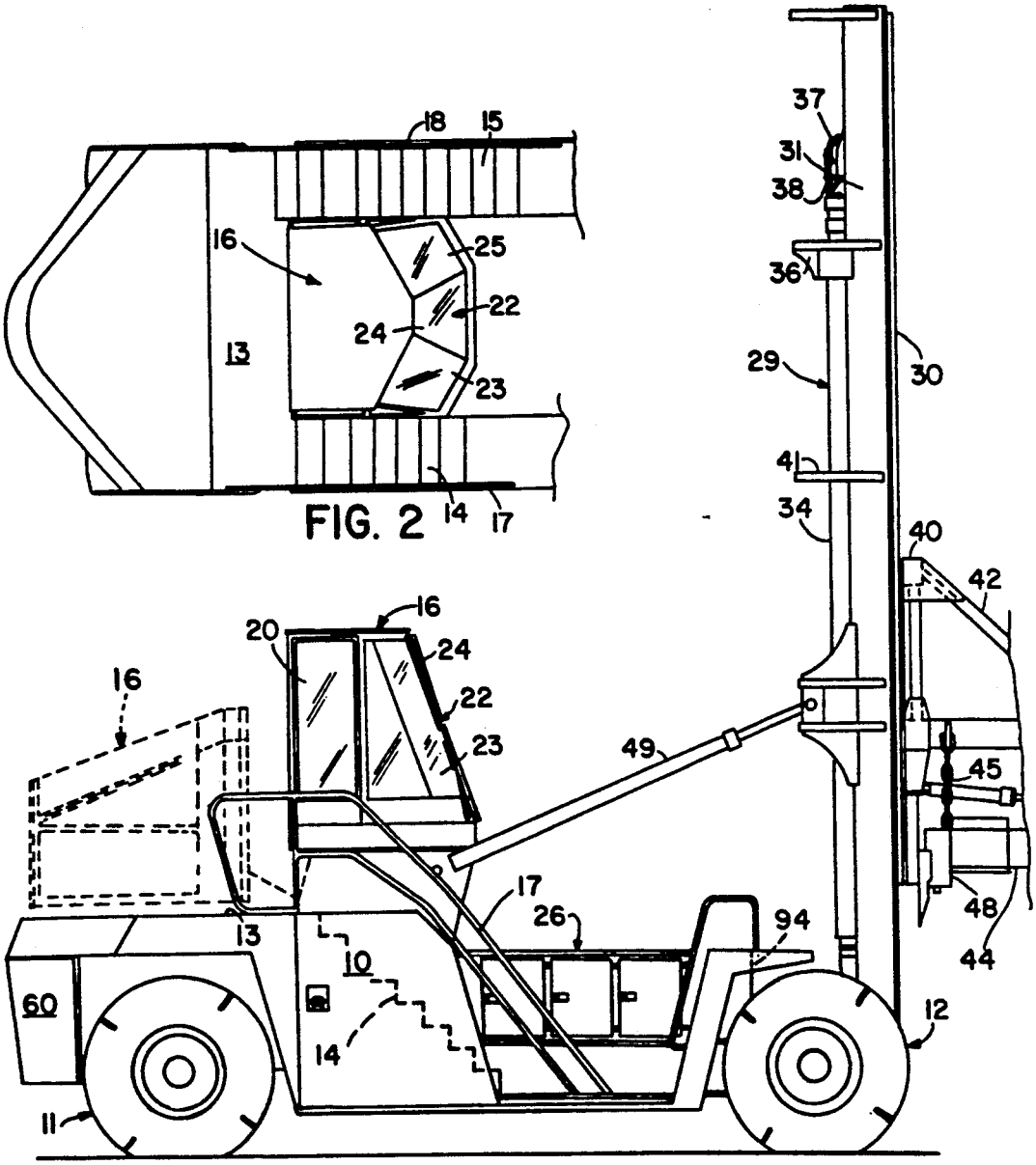
FIG. 1 is a right side elevational view of the container transporter showing the upright, carriage pick-up and lift frame in the lowered position, the cab being shown in the normal operating position, and in a dotted line, folded back service position over the counterweight for access to the engine compartment.
FIG. 2 is a partial plan view of the cab and counterweight area of FIG. 1.
Figure 3:
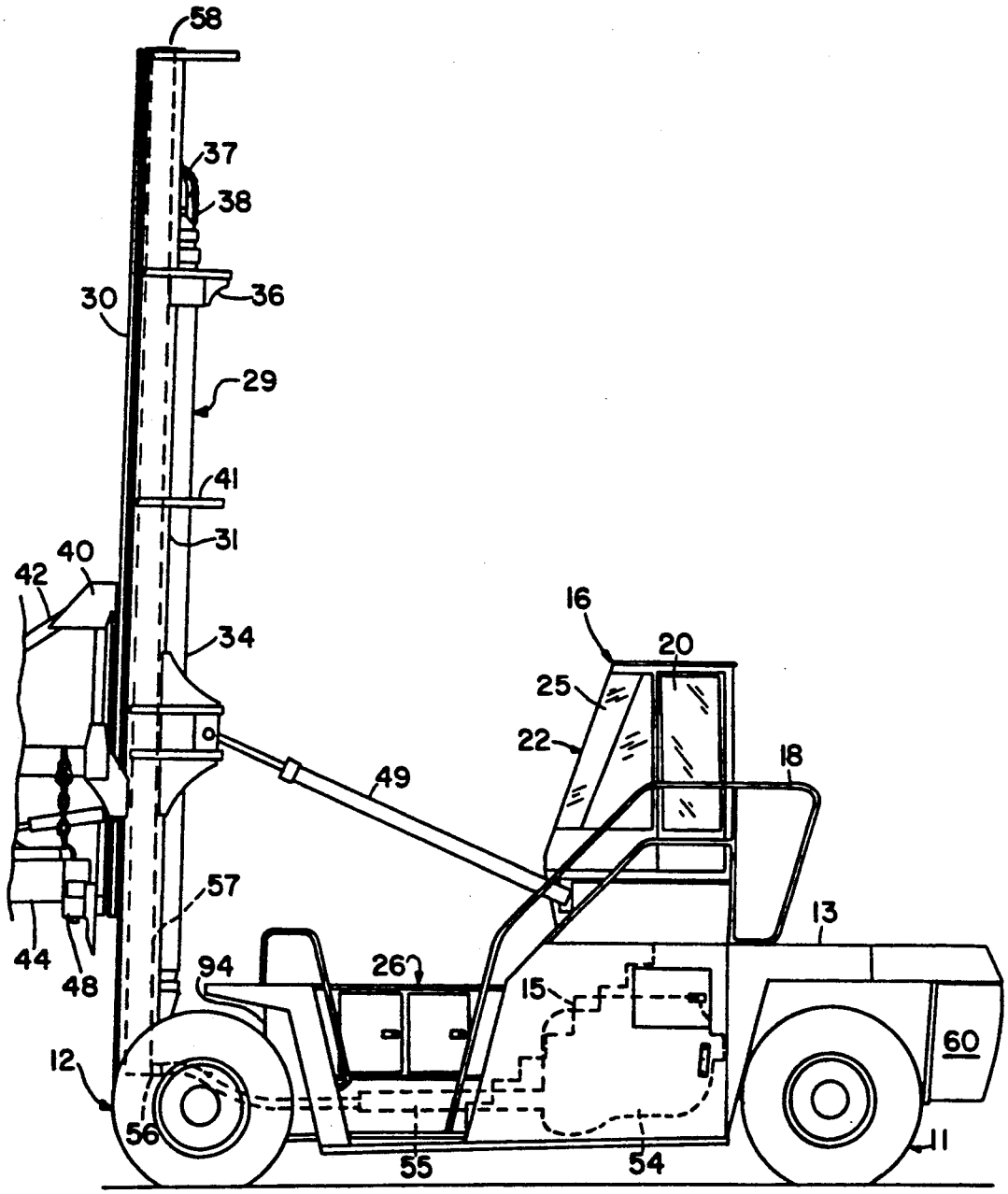
FIG. 3 is a left side elevational view of the transporter as depicted in FIG. 1 with the upright tilted back.

Referring now to FIG. 1 in a preferred embodiment of the invention there is shown a container transporter vehicle having a body 10 supported on rear wheels 11 from which the vehicle is steered and drive wheels 12 from which it is propelled in either forward or reverse. The body 10 has a deck 13 reached by stairways 14 and 15 (FIGS. 2 and 3) on either side of the vehicle for accessing an operator's cab 16. Mounting or dismounting from the deck 13 is assisted by handrails 17 and 18. The cab may be entered through doors 20 on opposite sides of the cab to reach an operator's station having a seat (not shown) facing a console with control levers and gauges situated in the cab for maximum forward or reverse visibility.

It is a unique feature of the present invention that the cab is constructed with a wide angle, wraparound front window 22 that extends from one side of the operator's station to the other (FIG. 2) inclined to the rear such that front trapezoidal panels 23, 24, 25 are at such an angle with the vertical so as to permit the range of vision from the operator's station to above the height of a stack of four ISO containers (FIG. 7) and extending below the operator's station to permit a line of sight at the front of the vehicle where containers would be spotted on the tarmac. Right and left panels 23 and 25 form a narrow seam with the center trapezoidal panel 24 without the assistance of any frame or divider other than a very narrow rubberized seal creating a more or less continuous horizontal expanse of window area across the front and partially on either side of the operator's station for viewing the lift frame when fully extended or collapsed.

At the front of the transporter body 26 is an upright or mast structure 29 having a movable inner rail section 30 which can be hydraulically extended upwardly on roller sets from parallel outer fixed rails 31 by means of a hydraulic cylinder 34, which lifts against a cross-member 36, having a chain sheave 37, over which travels a chain 38, fastened at one end to a carriage pick-up 40, traveling on rollers (not shown) on the inner rail section 30, and fastened at the other end to chain anchors (not shown) in cross member 36. The cross member 41 spans across the back of the outer rails providing lateral strength. By extending the hydraulic cylinder 34, the inner rail section 30 is elevated, reaching its maximum lift height (FIG. 7) for stacking containers four high. The carriage pick-up 40 supports a pick-up frame structure 42, (FIG. 4) from which is suspended a lift frame 44 by chains 45. Twist locks 48 at the corners of the telescoping ends of the lift frame are brought into engagement with locking receptacles 50 (FIGS. 7-8) in the upper corners of the container 52, allowing it to be lifted and transported; the transport position is depicted in FIG. 8. The lift frame 44 can be laterally extended by telescoping out the ends in opposite directions to align the twist locks 48 above the container locking receptacles 50 for either twenty or forty foot long containers.

A counterweight 60 mounted at the rear of the transporter partially counterbalances the load of a container 52 being lifted at the front by the upright which can be tilted forwards or backwards (FIG. 3) from vertical as required by a pair of hydraulic tilt cylinders 49. An engine 54, shown in dotted lines in FIG. 3, has an exhaust pipe 55 the front end of which enters an opening 56 in the outer rail 31 which is closed off throughout its length to form a tube 57 exhausting engine gases out the upper end 58 and away from the cab 16.

Figure 5:
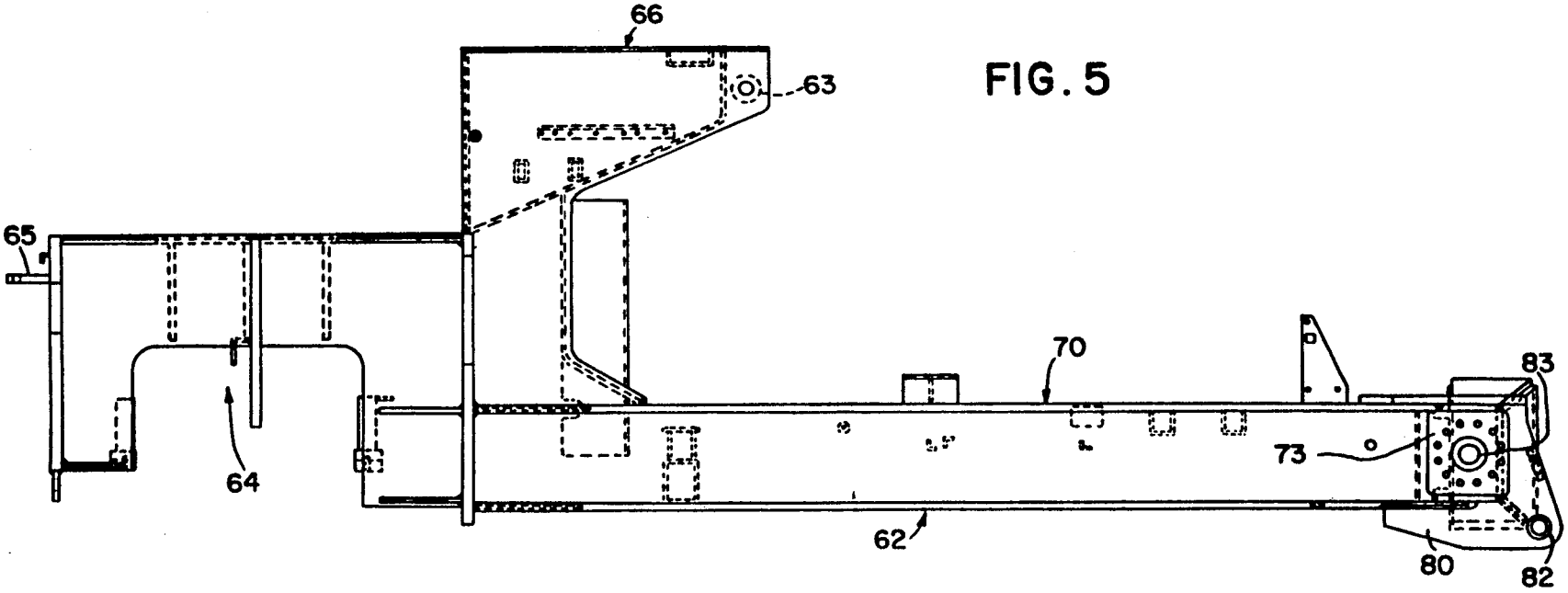
FIG. 5 is a right side view of the transporter frame showing the counterweight frame area at the rear, the tower structure for supporting the cab and the axle housing and upright mounting at the front.
Figure 6:
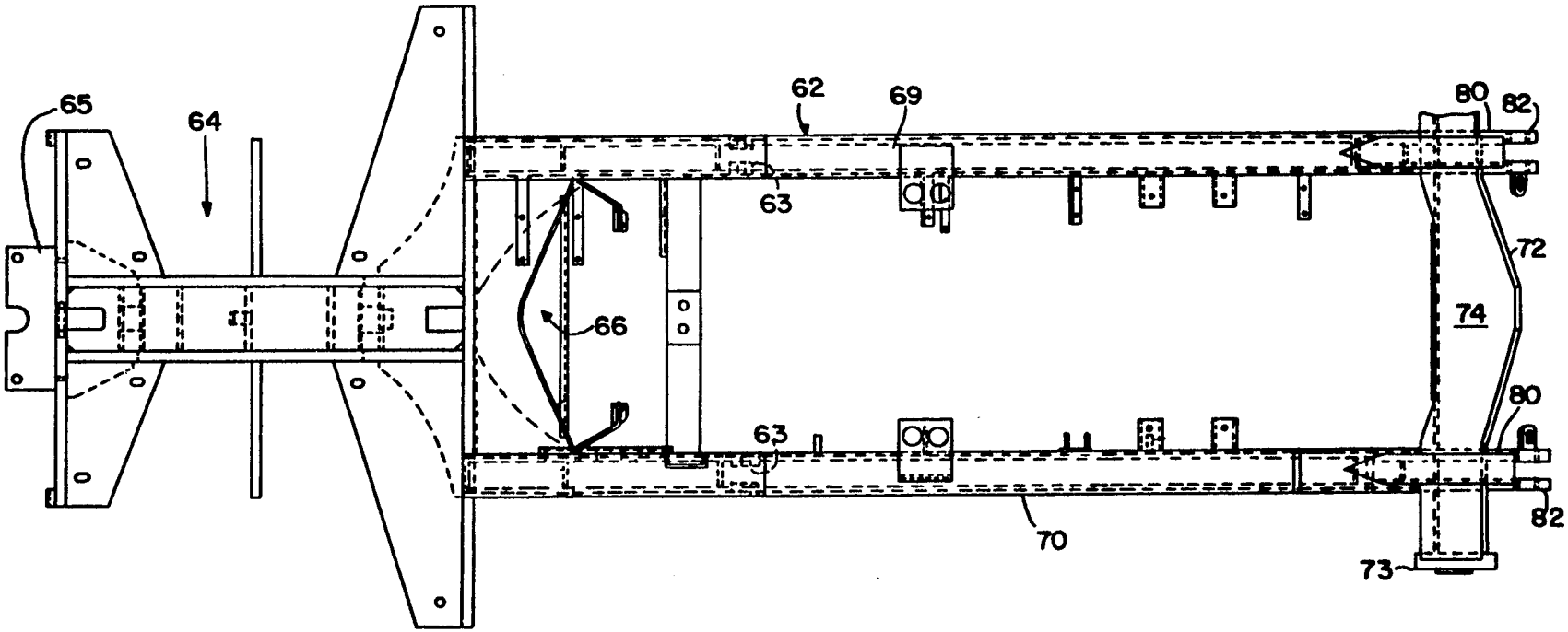
FIG. 6 is a plan view of the frame depicted in FIG. 5.

Referring to FIGS. 5 and 6, the transporter frame 62 has a rear counterweight frame portion 64 on which the counterweight 60 is mounted by means of a bracket 65 and a tower structure 66 behind the medial point of the frame 62 for supporting the cab structure 16 in a pivotal manner allowing the cab to be swung rearwardly for servicing the engine 54 (FIG. 1) and pivotally supporting at 63 the pair of tilt cylinders 49. The frame 62 is comprised of two parallel side rail members 69, 70 which are structurally interconnected at the front by cross-member 72, fabricated as a structural member for the frame but also as an axle housing having hub plates 73, one at each end, for mounting gear reduction planetary hubs (not shown) driven from a differential housed in a belled-out portion 74 of the housing 72. Engine 54 has a coupled torque converter for driving the wheels 12 and propelling the unit. The gear reduction planetary hubs on which the wheels 12 are mounted are driven by axle shafts passing through openings 83 in the ends of the hub plates 73. Fabricated at the ends of each frame rail 69, 70 are upright bracket arms 80, which pivotally support at 82 the lower ends of the upright outer rails 31.

Figure 4:
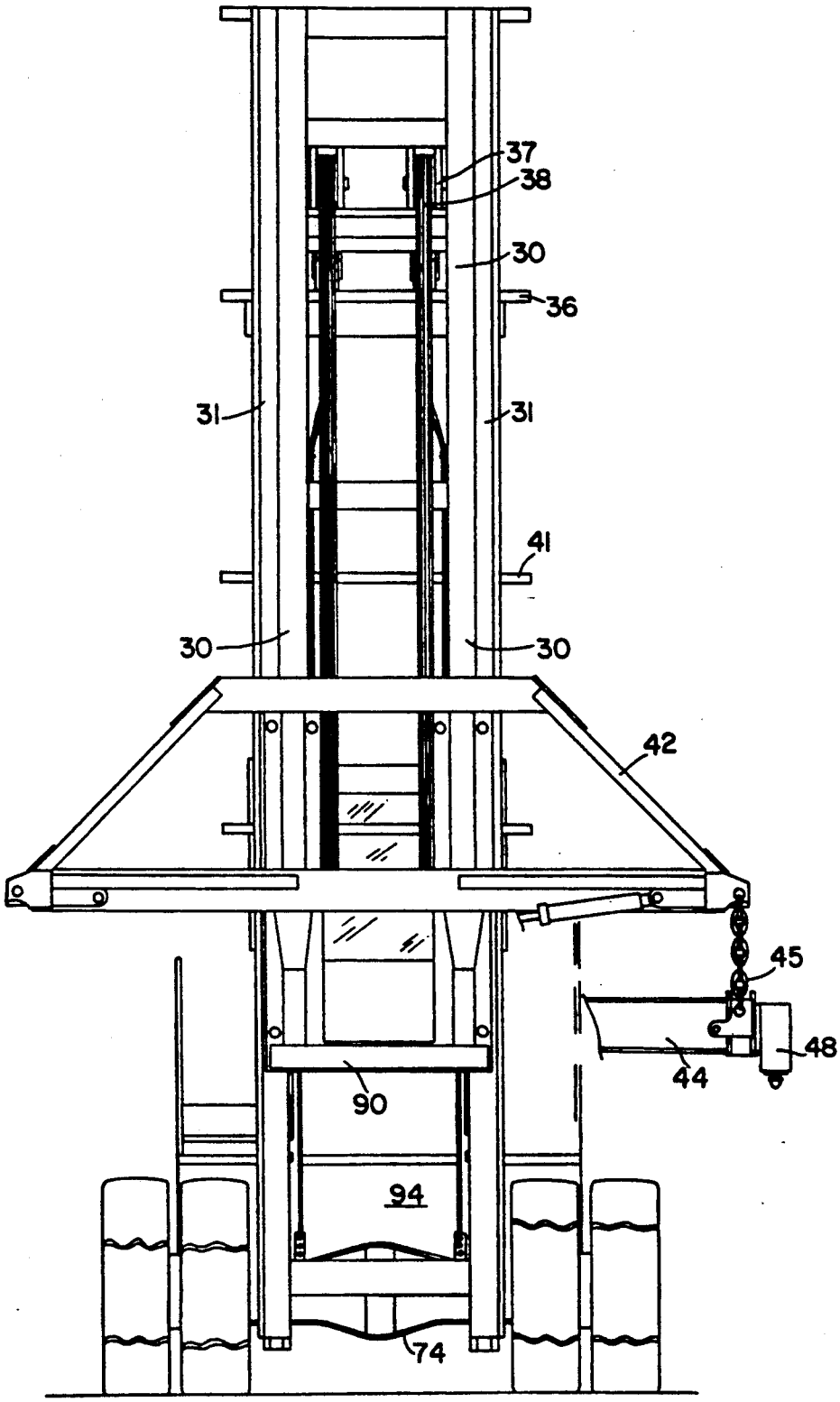
FIG. 4 is a front elevational view of the transporter depicted in FIGS. 1-3 showing the carriage pick-up with the lift frame suspended therefrom partially broken away.

As best shown in FIG. 4, the track width of the wheels 12 is narrower because of the fabricated upright bracket arm being on the frame rails allowing the wheels to be closer. This provides greater visibility since the wheels do not obscure the ends of the containers when spotting. Also, the inner rails 30 are tied together at their lower ends by cross-member 90, which in the lowered position of the upright terminates above the lower ends of the outer rails 31. However, to provide maximum lift and allow sufficient roller overlap for stability of the upright when fully extended (FIG. 7), the outer rails 31 are longer by this amount, the overall effect being to reduce the cross sectional thickness of the upright in the lowered position (dotted line position in FIG. 7), thereby opening up a line of sight from the operator's station between the outer rails 31 and below the cross member 90. In this connection, it is also noted that the body 26 is recessed at the front 94 behind the bell housing 74 to provide even greater visibility from the cab over the bell housing through the upright and out to a distance in front of the machine sufficient to enable the operator to accurately and rapidly spot a container on a predetermined line on the tarmac.

Figure 7:
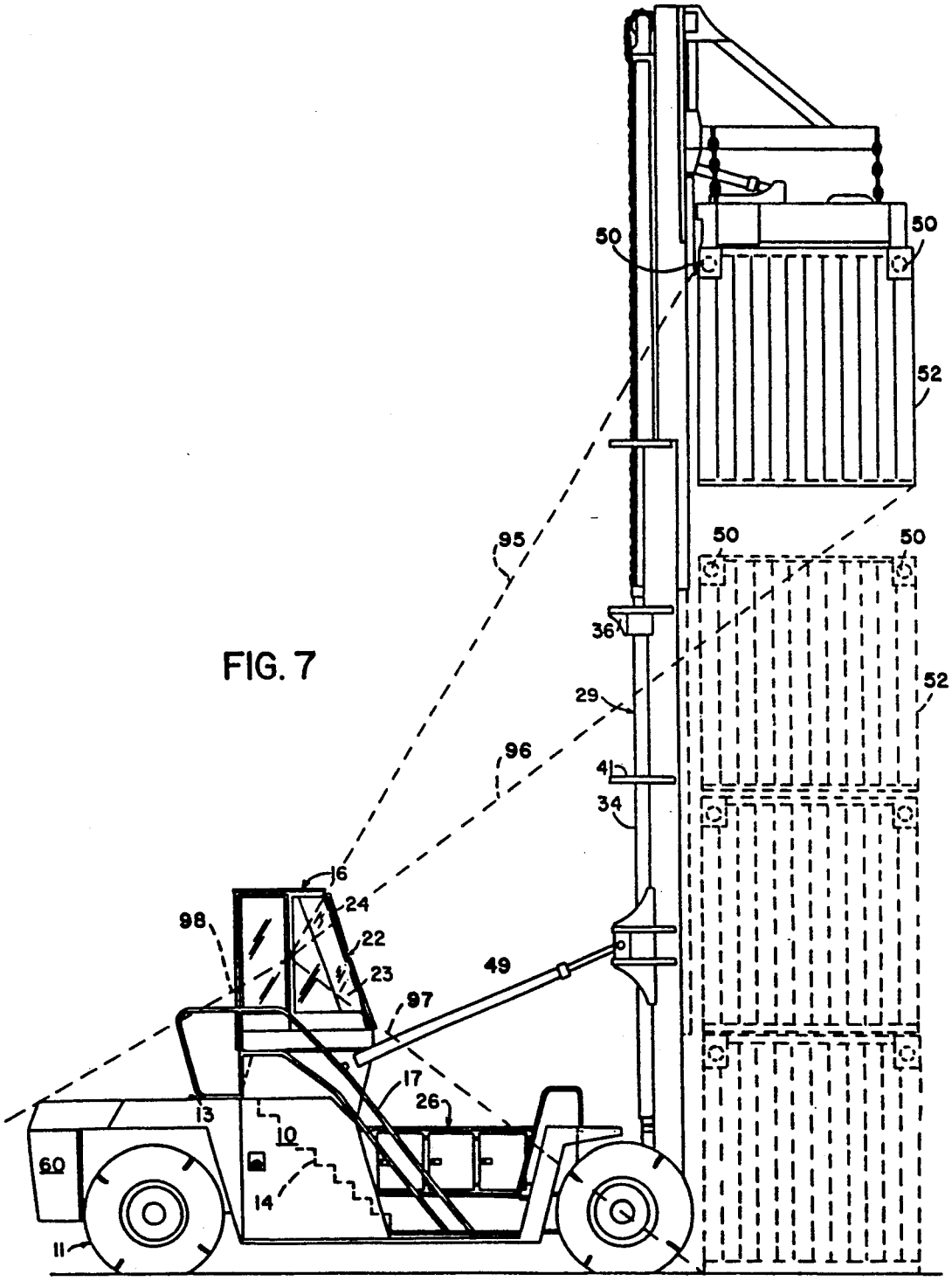
FIG. 7 is a side elevational view showing the upright extended to full height depicting the visibility vertically and horizontally in a stacking operation and to the rear for backing up.
Figure 8:
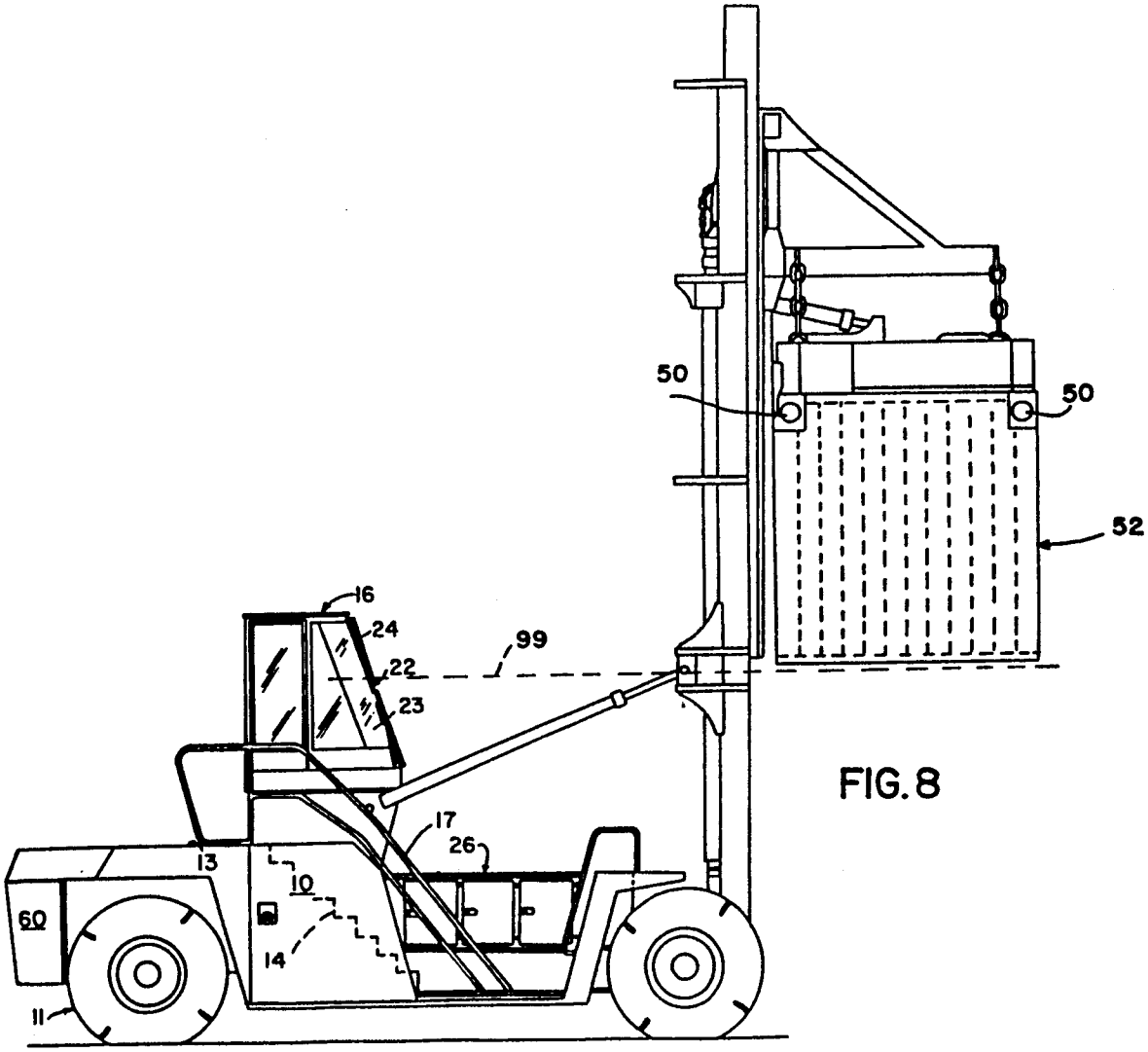
FIG. 8 shows the upright partially extended for visibility through the upright and beneath a container being moved in the transport mode.

In operation, the container transporter will pick up, transport, stack or spot containers 52 to a stack height of four standard ISO containers as depicted in FIG. 7. Hence, the operator's line of sight from the operator's station in the cab 16 will range from a line 95 observing the locking receptacles 50 of the container 52 being picked up or deposited onto a stack (shown in dotted lines) setting on the tarmac. The operator also has a view along the line 96 of the opposite corner of the container 52 being manipulated, and looking downwardly along line 97 to the front corner of the tarmac, he can place a first container accurately along the spotting lines drawn on the tarmac.

Additionally, the operator has a clear view out the back along line of sight 98 and can observe, before backing up, whether there are any objects or other hazards to operate the machine in reverse.

Additionally, the operator has (as shown in FIG. 8) a view through the upright beneath the container 52 while transporting it as shown by the line of sight 99 below the partially raised inner rails 30.

Figure 9:
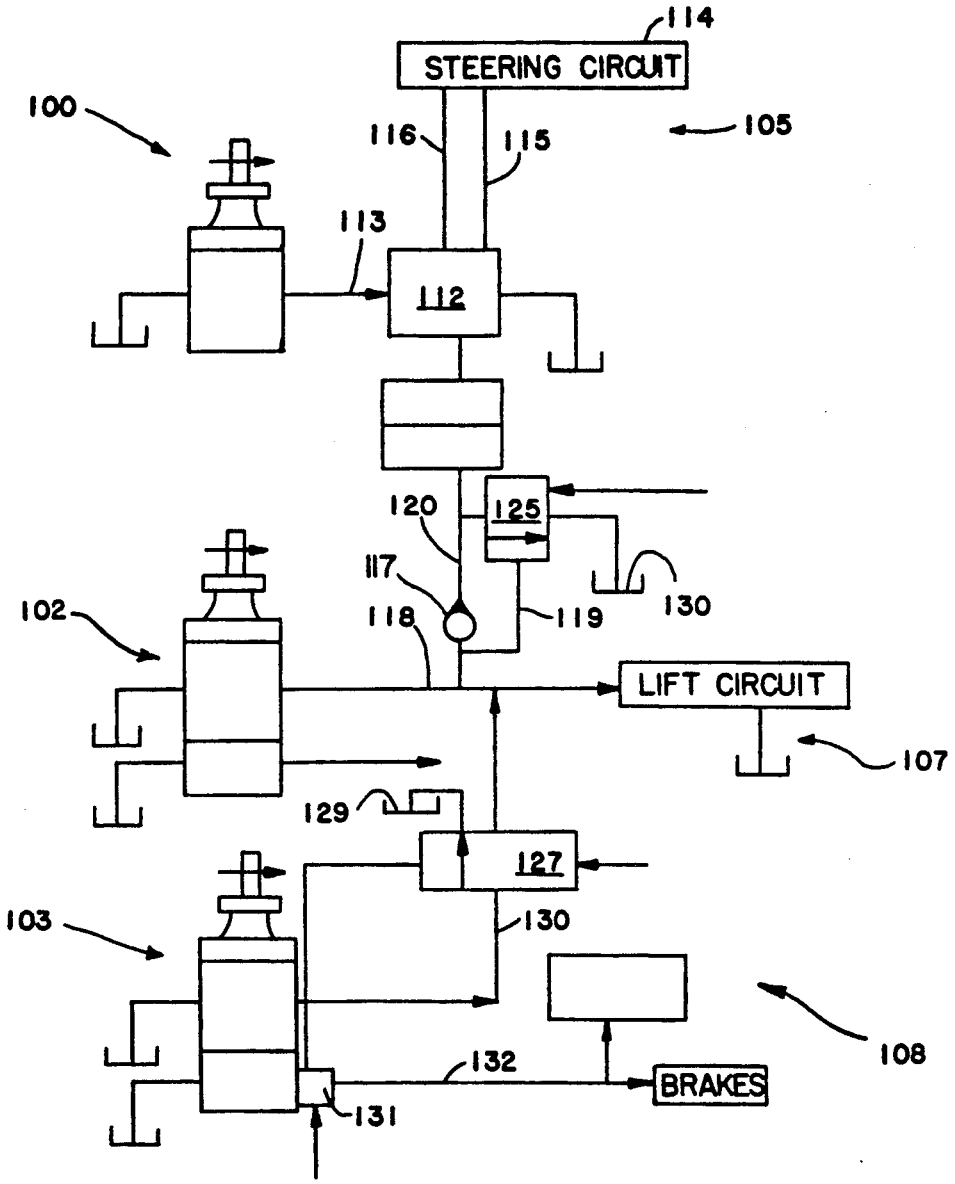
FIG. 9 shows a hydraulic lift circuit for sensing loads or engine speed to match lift speed with the load.

As shown in FIG. 9, a portion of the hydraulic circuit is depicted where three gear pumps 100, 102, 103 are driven off the torque converter at engine speed each having an independent circuit for functional applications required in operation of the container handler including a steering circuit 105 served by pump 100, a lifting circuit 107 connected to the pump 102 and a brake circuit 108 served by pump 103, however circuits 105 and 108 are also interdependent with lift circuit 107 to allow all three pumps to be connected to the lift circuit depending upon the sensing of engine speed or the weight of a load being lifted by the upright. The steering circuit 105 includes a steering valve 112 connected to the pump 100 by hydraulic line 113 the output of which is directed to a steering cylinder, represented by the block 114, mounted at the rear between the frame and steer axle for steering the transporter in a known manner. Hydraulic lines 115 and 116 connect the steering valve 112 to the steering cylinder. Line 120 also connects the output of pump 100 to the lift circuit. The lift circuit 107 connects the output of pump 102 to the hydraulic cylinder 34 through line 118 for raising and lowering the upright 29. A diverter valve 127 senses engine speed and at 1800 rpm shifts to combine the output of pump 103 with that of pumps 100 and 102 in line 118 to achieve the highest lift speed when the engine can operate at high rpms and low torque output because of handling light loads or empty containers. Another diverter valve 125 operates according to differential pressure sensed because of check valve 117 between ends 120 and 119 and when the differential pressure exceeds 1500 psi, valve 125 diverts the output of pump 100 to reservoir 130 and because of low engine speeds valve 127 also diverts the output of pump 103 to reservoir 129, such that when the loading conditions exceed both the differential pressure setting and engine speed setting, the torque output is maximized or prioritized for the lift circuit 107 and pumps 100 and 103 are diverted out of the system and only pump 102 is connected to the lift circuit conserving the engine torque for lifting at low speed maximum load conditions. However, for light loads at high engine speed low torque requirements the diverter valve 125, 127 both are shifted in the direction to deliver the output of pumps 100,103 through line 118 to the lift cylinder 34 to provide maximum fluid flow to the lift circuit achieving higher speeds of lift than would otherwise be possible without overloading the engine.

Thus, it will be increasingly apparent that the productivity of the container transporter is greatly augmented as visualized in FIG. 7 when approaching a 4-high stack of containers approximately 40 feet in height with the object of picking up the top most container. The operator will want to achieve maximum lift speed to reach this height as quickly as possible and since the lift frame is not carrying any container, the engine can operate at maximum rpm. Both diverter valves 125, 127 will be shifted to direct the output of pumps 100 and 104 to the lift circuit and combine their outputs with pump 102 to achieve the maximum lift speeds.

On the other hand, if the container being lifted by the lift frame is at rated capacity of the container handler, the maximum engine torque will be required for operating pump 102 and at the lower engine speed, and high differential pressure valves 125, 127 will divert the output of both pumps 100 and 103 to reservoirs 129, 130 such that the maximum torque of the engine is committed to operating pump 102 thus matching the load with the engine torque.

Also, for intermediate loads one or the other valve 125, 127 will be shifted to divert the output of either pump 100 or 103 as conditions require, to change the lift speed according to engine speed or pressure differential conditions, such that the lift speed is more nearly matched to the engine torque output and weight of the load to achieve the optimum lift speed under those given conditions.

For those skilled in the art, it will be kept in mind that various changes or modifications in the structure, components or relative arrangement of parts may be made without departing from the scope of the invention which is claimed as follows:

We claim:

1. In a container transporter vehicle having ground engaging front and rear wheels to propel and maneuver it over a surface, a counterweight supported at the rear of the vehicle, load lifting means supported at the front of the vehicle for picking up, transporting, lifting, and spotting standard ISO shipping containers having a maximum lift height capable of stacking up to four containers on the surface, an improvement comprising a tower structure projecting upwardly from the vehicle intermediate the front and rear wheels thereof spaced longitudinally a greater distance from the load lifting means than from the counterweight, a cab containing an operator's station defining an eye level position from which up to four containers may be viewed in stacked relation to each other, said cab being mounted on the tower structure and having a front window inclined rearwardly relative to the load lifting means, the longitudinal axis of said window extending above and below the eye-level position in the cab providing a vertical range of vision encompassing the stacked shipping containers from the eye-level position, said load lifting means comprising parallel outer rails, parallel inner rails mounted on rollers extensible upwardly from the outer rails, hydraulic cylinder means connected between the outer and inner rails for extending or collapsing the inner rails within the outer rails, first and second pumps hydraulically powering the cylinder means, the output of the first pump confined to the hydraulic cylinder means to provide a first lift speed, the output of the second pump connected normally to a separate function associated with operating the vehicle and valve means including pressure differential sensing means for measuring the difference in pressure between the two outputs for diverting the output of the second pump to augment that of the first when the pressure differential exceeds a predetermined setting to provide a second lift speed.

2. The improvement as defined in claim 1 wherein an engine propels the vehicle and operates its various functions, and a third pump is driven by the engine, said third pump being hydraulically connected to the hydraulic cylinder means and normally operates a separate function of the vehicle, said valve means including speed sensing means for sensing the speed of the engine for diverting the output of the third pump to the hydraulic cylinder means when the engine speed exceeds the predetermined setting, the output of the third pump augmenting that of the first and second pumps to provide a third lift speed.

3. The improvement as defined in claim 1 wherein the tower structure is located rearwardly of a medial position between the front and rear wheels of the vehicle.

4. The improvement as defined in claim 1 wherein the window is comprised of a vertically elongated trapezoidal center panel joined on each side by right and left panels at an angle to the longitudinal axis of the center panel whereby the window wraps around the front of the operator's station.

5. The improvement as defined in claim 1 wherein the vehicle has a frame comprising a pair of side rail members, a cross member structurally connecting the side rail members, said cross member being a hollow fabricated structure and providing an axle housing, drive elements for propelling the vehicle within the housing, the front wheels rotatively mounted on opposite ends of the axle housing driven by said drive elements, the rail members and axle housing being integral with each other, such that the ground clearance of the frame is reduced whereby the line of sight from the eye-level position in the operator station over the axle housing is increased to include the area where the containers are stacked.

6. The improvement as defined in claim 1 wherein the frame side rail members each have a bracket arm integral therewith, each bracket arm defining a pivotal mounting for said load lifting means below the axis of said axle housing and hydraulic cylinder means extending between the tower structure and the load lifting means for tilting it forwardly or rearwardly from a vertical position whereby the mounting locations of the load lifting means are spaced apart no wider than the side rail members providing an unobstructed horizontal line of sight from the eye-level position in the operator station laterally of the load lifting means to the ends of said container.

7. The improvement as defined in claim 6 wherein the bracket arms project forwardly and downwardly for mounting the outer rails of the load lifting means below the axle housing.

8. The improvement as defined in claim 7 wherein one outer rail of the load lifting means is closed off throughout its length, but open at the top, to provide a tubular passage, means connecting the engine exhaust to the tubular passage so that the exhaust gasses are vented out through the top of the rail thereby minimizing noise and exhaust levels in the cab.

9. Improvement as defined in claim 8 wherein the inner rails have upper and lower ends, said lower ends terminating above the bottom of the outer rails in the lowered position thereof whereby the line of sight from the eye-level position in the operator's station between the outer rails is enhanced in the lowered position of the inner rails.

10. In a container transporter vehicle having front and rear ground engaging wheels for propelling and maneuvering the vehicle over a surface, a counterweight supported at the rear of the vehicle, an upright supported at the front of the vehicle capable of being elevated or collapsed in stacking shipping containers, a lift frame of rectangular configuration sized to fit over a container lifted by the upright, engagement means at each corner of the lift frame for attaching the lift frame to containers, an improvement comprising a tower structure projecting upwardly from the vehicle at a longitudinal position approximately medially between the front and rear wheels of the vehicle, a cab containing an operator station mounted on a tower structure, a window in the front of the cab inclined rearwardly at an angle from vertical extending above the operator's normal head position to afford an unobstructed line of sight of the lift frame engagement means in the elevated position of the upright, said front window having a central trapezoidal panel, a right and left panel adjoining said center panel at an angle to the longitudinal axis of the center panel, the joints between said panels forming narrow seams such that the window wraps continuously around the front of the operator's station providing a substantially unobstructed view to the front and sides, said vehicle having a frame comprised of parallel side rails, a cross member connected adjacent to the front of the side rails providing structural support for the side rails, said cross member being fabricated as a hollow structure providing an integral drive axle housing of the vehicle frame, aligned axle hubs rotatably mounted at opposite ends of the housing, and means for mounting the wheels to the hubs that propel the vehicle, said upright comprised of a pair of outer rails, a pair of inner rails extensible from and collapsible into the outer rails, the outer rails and the inner rails being partially overlapped with each other at their lower ends to provide a wider viewing area between the outer rails when the inner rails are fully collapsed, and when extended, being overlapped at their upper ends by substantially the same amount to provide greater stiffness in the fully extended position of the upright.

* * * * *